US008181959B2

(12) United States Patent
Bichsel et al.

(10) Patent No.: US 8,181,959 B2
(45) Date of Patent: May 22, 2012

(54) METHOD AND APPARATUS FOR PROCESSING PRINT PRODUCTS

(75) Inventors: Michael Bichsel, Zofingen (CH); Simon Von Arb, Olten (CH)

(73) Assignee: Mueller Martini Holding AG, Hergiswil (CH)

( * ) Notice: Subject to any disclaimer, the term of this patent is extended or adjusted under 35 U.S.C. 154(b) by 0 days.

(21) Appl. No.: 12/771,485

(22) Filed: Apr. 30, 2010

(65) Prior Publication Data

US 2010/0276878 A1 Nov. 4, 2010

Related U.S. Application Data

(60) Provisional application No. 61/175,096, filed on May 4, 2009.

(30) Foreign Application Priority Data

May 1, 2009 (EP) ..... 09405075

(51) Int. Cl.
*B65H 39/00* (2006.01)

(52) U.S. Cl. .... 271/306; 271/69; 270/52.22; 270/52.14; 270/52.16

(58) Field of Classification Search ..... 271/69, 271/204, 306; 270/52.22, 52.21, 52.16, 52.14, 270/52.2

See application file for complete search history.

(56) References Cited

U.S. PATENT DOCUMENTS 4,714,394 A * 12/1987 Ehlscheid et al. ..... 414/789.6
4,801,132 A * 1/1989 Reist ..... 270/52.22
5,088,711 A 2/1992 Newsome
5,660,382 A * 8/1997 Meier ..... 270/52.16
5,957,449 A * 9/1999 Luthi ..... 271/204
6,003,859 A * 12/1999 Reist ..... 271/204
6,669,192 B2 * 12/2003 Reist ..... 271/225
6,814,352 B2 * 11/2004 Ramseier ..... 271/69
7,192,028 B2 * 3/2007 Kramer ..... 271/306
7,287,748 B2 * 10/2007 Maeder et al. ..... 270/52.05

(Continued)

FOREIGN PATENT DOCUMENTS

CH 655 076 A5 3/1982

(Continued)

OTHER PUBLICATIONS

European Search Report dated Oct. 23, 2009 EP App. No. 09405075.4.

*Primary Examiner* — Kaitlin Joerger
(74) *Attorney, Agent, or Firm* — Venable LLP; Robert Kinberg; Ryan M. Flandro

(57) ABSTRACT

A method and apparatus for the processing of print products. The method may include conveying individually the print products with a feeding device along a feeding section, transferring individually the print products from the feeding section to a further processing section, and generating control signals from a control unit. The control signals may correspond to further treatment of each individual print product and to the transfer of a print product to the further processing section such that it can be processed further. The apparatus may include a feeding device configured to convey the print products individually along a feeding section, a transfer device configured to individually transfer the print products from the feeding device to a further processing device, and a control unit configured to generate control signals to control the transfer of the print products from the feeding device to the further processing device.

19 Claims, 2 Drawing Sheets

U.S. PATENT DOCUMENTS

| | | | | |
|---|---|---|---|---|
| 7,516,839 | B2 * | 4/2009 | Maeder et al. | 198/778 |
| 7,568,685 | B2 * | 8/2009 | Silberbauer | 270/58.07 |
| 7,588,236 | B2 * | 9/2009 | Belanger | 270/52.16 |
| 7,665,720 | B2 * | 2/2010 | Mori et al. | 270/52.16 |
| 7,731,167 | B2 * | 6/2010 | Prim et al. | 270/52.22 |
| 7,762,385 | B2 * | 7/2010 | Maeder et al. | 198/778 |
| 7,946,566 | B2 * | 5/2011 | Schupbach | 270/52.17 |
| 2007/0069442 | A1 * | 3/2007 | Abegglen | 270/52.14 |
| 2007/0194519 | A1 * | 8/2007 | Belanger | 271/204 |
| 2008/0128983 | A1 | 6/2008 | Prim et al. | |

FOREIGN PATENT DOCUMENTS

| | | | |
|---|---|---|---|
| CH | 664 138 | A5 | 10/1984 |
| DE | 195 23 164 | A1 | 2/1996 |
| EP | 0 272 398 | A1 | 6/1988 |
| EP | 1 146 000 | A2 | 10/2001 |
| EP | 1 227 053 | A2 | 7/2002 |
| EP | 1 277 685 | A1 | 1/2003 |
| WO | WO-94/02398 | A1 | 2/1994 |
| WO | WO-98/03419 | A1 | 1/1998 |

* cited by examiner

METHOD AND APPARATUS FOR PROCESSING PRINT PRODUCTS

CROSS-REFERENCE TO RELATED APPLICATION

This application claims the priority benefit of European Patent Application No. 09405075.4-1256, filed on May 1, 2009. This application also claims the priority benefit under 35 U.S.C. §119(e) of U.S. Provisional Patent Application No. 61/175,096, filed on May 4, 2009. The subject matter of each of the foregoing applications is incorporated herein by reference.

BACKGROUND OF THE INVENTION

1. Field of Invention

The invention relates to a method for the processing of print products, wherein the print products are supplied individually along a feeding section and are transferred individually to a further processing section to be processed further. The invention also relates to an apparatus for realizing methods of this type.

2. Related Art

When processing print products, these products are imprinted with the aid of a rotary press, operating at a printing speed that is normally predetermined, and are then subjected to further processing operations, such as, for example, folding, cutting and trimming, stitching, inserting or the like. The processing speeds of the individual further processing operations can vary. With a continuous production, also called an "online production," the total production speed must be adjusted to the further processing speed of the further processing operation with the slowest speed, resulting in a reduction of the productivity on the whole.

To avoid these problems, it has already been proposed that, following the individual further processing steps, the print products be stored temporarily in buffer systems such as, for example, by winding them around a winding system. Then, at an appropriate time, those print products temporarily stored in the buffer system may be unwound from the winding system and subjected to the further processing steps. As a rule this is tied to considerable expenditure since it requires on the one hand that a buffer system be made available and, on the other hand, that additional means be provided for the standard buffer systems, e.g. winding systems or the like, for the further processing of the print products in the intermediate storage. Corresponding methods are described, for example, in the documents EP 0 272 398 A1, WO 94/02398 and CH 664 138 A5 as well as in the CH 655 076 A5, each of which is incorporated herein by reference.

In view of the problems described in connection with the use of buffer systems, it has been proposed that the flow of print products, reaching a slow-operating further processing device, if applicable be divided and conveyed to several further processing devices. In that case, only each second, third or fourth print product, for example, of the incoming product flow is supplied to a specific further processing device, so that even with a particularly high feeding speed, a slow further processing with two, three or more processing systems is possible without having to reduce the production speed on the whole. In the process, the flow of supplied print products is divided according to fixed division ratios into two, three or more partial flows. It has turned out that a high production speed can be achieved with this method, to be sure, but that the capacity of the further processing devices frequently is not utilized completely.

When using known methods for dividing the flow of supplied print products, the insufficient use of the capacity of further processing devices results from the fact that the flows are divided according to fixed ratios which are determined by the number of available further processing devices. The speed of the further processing device is consequently tied directly to the feeding speed and cannot be influenced further.

In view of the above described problems, it is an object of the present invention to provide methods for the processing of print products which allow an optimum utilization of the capacity of individual further processing devices, without reducing the production speed on the whole, as well as to provide apparatuses for realizing the aforementioned methods.

SUMMARY

In an embodiment of the invention, a method for the processing of print products may include conveying individually the print products with a feeding device along a feeding section, transferring individually the print products from the feeding section to a further processing device along a further processing section, and generating control signals from a control unit. The control signals may correspond to further treatment of each individual print product and to the transfer of precisely one print product to the further processing device.

In another embodiment of the invention, a method may be provided in which, for each individual print product and/or for each individual operation of transferring precisely one print product to a further processing section, a control signal is generated which determines the further treatment of the print product.

In a further embodiment of the invention, a dynamic control or regulation of the further processing of the print products is possible because a control signal is generated for each individual print product and/or for each individual transfer operation, which control signal determines the further processing of the product. By utilizing such dynamic control, there is no fixed division but, rather, a dynamic adaptation of the print product transfer to the production requirements.

In another embodiment of the invention, a control signal is generated for each individual print product that is supplied. If a control signal in the form of a release signal is present for the supplied print product, then the respective print products is transferred from a feeding section to a further processing section. On the other hand, if a control signal in the form of a holding signal is present, the respective print product will not be transferred to the further processing section, but is instead transferred from the feeding section to an alternative processing section or to a storage device.

For those production operations in which a further processing is possible at higher speeds, meaning a higher number of print products can be processed than can be supplied during each time unit, the release signal is present. A case of this type can occur, for example, if the further processing comprises several further processing steps for which a first processing step is more involved than a following processing step. In that case, all supplied print products are also transferred to the further processing device, even if the capacity of the further processing device is not utilized completely. However, as a result of generating a control signal for each individual transfer operation that involves transferring precisely one print product, a precisely defined feeding of the further processing section with print products is made possible. The further processing section can thus be provided with additional print products, if applicable by using an additional feeding device, so as to achieve a continuous flow of print products along the further processing section and thus an optimum utilization of the capacity of the further processing device.

For those production operations where the supplied print products arrive at a higher speed, meaning a higher number of print products supplied during each time unit, than can be handled by the further processing system, the holding signal is present. As a result of the dynamic control of the transfer of the print products from the supplied flow of products (i.e., from the feeding section) to the further processing section, the number of print products removed from the supplied product flow precisely matches the number which can be processed by the further processing device without causing a "print product jam" in front of the further processing device.

In another embodiment of the invention, a first control signal determines whether or not the supplied print product in the feeding section that reaches a transfer region is transferred to the further processing section. A second control signal determines when the transfer will take place. In the process, the control signals are usefully generated based on the feeding speed, meaning the number of print products supplied per unit of time, and based on the further processing speed, meaning the number of print products per unit of time which are processed further.

Considering the possibility that the supplied flow of print products in the feeding section can have gaps and that unexpected problems can also occur during the further processing, it has proven useful within the framework of embodiments of this invention, so as to ensure an uninterrupted production with optimum production speed, if the print products are transferred from the feeding section to a storage device designed to accommodate a number of print products and from there to the further processing device. It has also proven useful if the control signals are generated based on the number of print products accommodated in the storage device. With this processing variant, the print products removed from the feeding device and/or the feeding section are thus initially supplied to a storage device and are then transferred from the storage device to the further processing section. For example, if the flow of supplied print products in the feeding section contains gaps that can be detected with the aid of a photoelectric cell, the second control signals can be influenced in such a way that no more print products will be transferred from the storage device to the further processing device. In that case, any gaps appearing in the flow of print products for the further processing device can be filled, if applicable, with the aid of an additional feeding device that follows the storage device in downstream direction. If the gaps in the flow of print products are smaller and cannot easily be detected by a photo-electric cell, the removal of print products from the storage device results in a reduction of the filling level for the print products in the storage device. In that case, the further processing speed can be lowered slightly, starting with the desired further processing speed, so that a desired filling level is again achieved for the print products in the storage device. On the whole, by using a storage device and as a result of the dynamic transfer of print products with the aid of control signals for each individual product and/or each individual transfer operation, the actual further processing speed can be allowed to fluctuate around a desired value based on the existing production conditions, respectively the filling level of the storage device. The difference between the actual further processing speed and the desired value for the further processing speed is referred to as a "control offset" in the following.

According to another embodiment of the invention, the print products are conveyed along the feeding section while held by a number of grippers, designed to respectively convey a single print product, and are released by the grippers depending on the first control signals.

In another embodiment, a further processing of the print products with the aid of an inserter for inserting supplements into finished print products may be provided. For this, the print products may be conveyed along the further processing section inside the pockets of a pocket conveyor which are open at the top, wherein these pockets are supplied with print products in response to the additional or second control signals, if applicable by removing the products from a storage device. The storage device and the transfer device for removing the print products can be embodied as a standard print product feeder.

With respect to control technology according to another embodiment of the invention, the print products may be conveyed along the feeding section with the aid of a feeding device such as, for example, a clocked feed conveyor provided with grippers. Precisely one first control signal (e.g., a release signal or a holding signal) may be generated for each conveying cycle during which precisely one print product moves past a removal location along the feeding section. The control can be realized such that for each conveying cycle a clocking rate representing this conveying cycle is compared to a holding rate which is determined based on the feeding speed and the further processing speed. If the clocking rate corresponds to the holding rate, a first control signal in the form of a holding signal may be generated which triggers a holding of a print product in the feeding section. If the clocking rate and the holding rate do not coincide, a first control signal in form of a release signal for releasing a print product may be generated. Following the generating of a holding signal, the holding rate can be increased by a predetermined amount that is usefully determined on the basis of the feeding speed and the further processing speed. Within the meaning of an especially dynamic control, it has proven useful if the clocking rate and the holding rate are reset to 0 once a predetermined limit number is reached, so that a new control regulating cycle can begin.

Where the further processing speed is higher than the feeding speed, an optimum use of the capacity of the further processing device may be possible under all operating conditions if additional print products are supplied to the further processing section based on the locations determined by the second control signals and/or based on the times determined for the second control signals. A continuous print product flow may be generated with these additional print products along the further processing section.

According to a further embodiment of the invention, an apparatus for processing print products may comprise a feeding device configured to convey the print products individually along a feeding section, a further processing device configured to receive and convey the print products along a further processing section, a transfer device configured to transfer the print products from the feeding device to the further processing device, and a control unit configured to control the transfer of the print products from the feeding device to the further processing device. The control unit may be configured to generate control signals corresponding to further treatment of each individual supplied print product and to the transfer of precisely one print product via the transfer device to the further processing device.

In another embodiment of the invention, the transfer device may be provided with a storage device designed to accommodate a number of print products, wherein the print products can be transferred from the storage device to the further processing device.

To ensure an optimum output according to another embodiment of the invention, the storage device can comprise a detection device for detecting the number of print products stored therein and for transmitting the respective detection signals to the control unit, wherein the control unit can generate control signals based on the detection signals. The control unit may be designed for adjusting the feeding speed of the feeding device and/or the further processing speed of the further processing device and for generating the control signals based on the feeding speed and/or the further processing speed. An additional feeding device that is also controlled by the control unit can be assigned to the further processing device for supplying additional print products to the further processing section.

BRIEF DESCRIPTION OF THE DRAWINGS

These and other features and advantages of the invention will be further understood from the following detailed description of an embodiment with reference to the accompanying drawings, in which.

DETAILED DESCRIPTION

Figure 1:
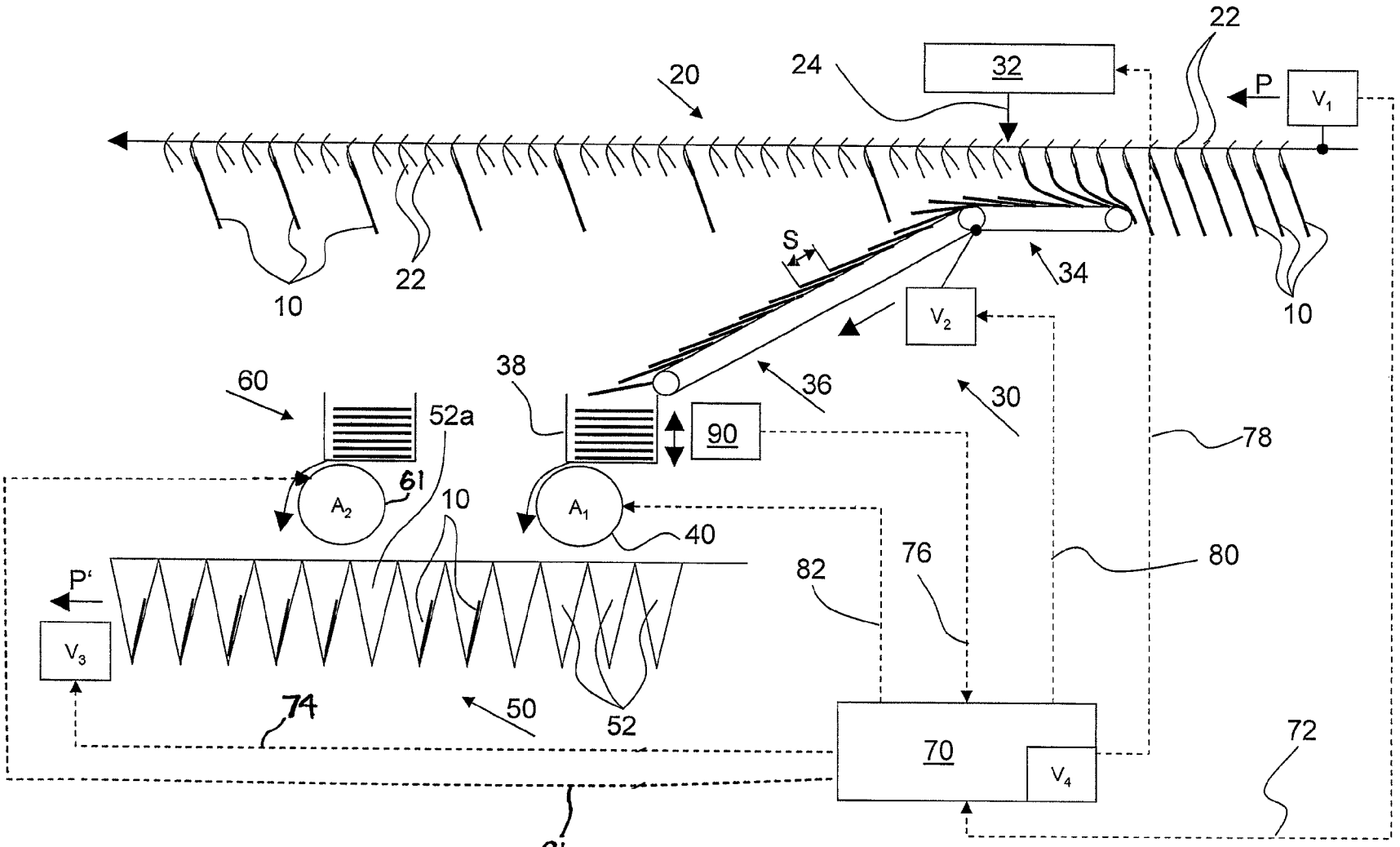
FIG. 1 depicts a schematic representation of an apparatus according to an embodiment of the invention.

The apparatus shown in the embodiment depicted in FIG. 1 comprises a feeding device such as, for example, a feed conveyor 20 having grippers 22, a control unit 70, a further processing device embodied as, for example, an inserter including a pocket conveyor 50, and an additional feeding device 60 assigned to the pocket conveyor 50. The print products 10 are gripped along a product fold by the grippers 22 of the feed conveyor 20 and are conveyed while suspended from these grippers 22 in the direction provided by the arrow P, along a feeding section that may also be curved. The feeding speed $V_1$ can be predetermined, for example by the printing speed of the rotary press.

A transfer device 30 comprises a release device 32, as well as two conveying belts 34 and 36 on which the print products 10 are supplied in the form of an overlapping flow to a storage device 38. With the aid of the release device 32, the grippers 22 of the feed conveyor 20 can be opened selectively in response to control signals transmitted via a line 78, such that the gripped print products 10 are released and deposited on the conveyor belt 34. In the process, a control signal is generated for each print product 10 that moves past the respective release location 24, respectively for each gripper 22, wherein this signal is transmitted from the control unit 70 via a signal line 78 to the release device 32. The control signal triggers either the release of the print product 10 or the continued holding of the print product 10 by the respective gripper 22.

The released print products 10 are conveyed by the conveying belts 34 and 36, also called (collectively) an intake conveyor, in the form of an overlapping flow to a storage device 38 from which they can be withdrawn with the aid of a withdrawing device 40 and can be inserted into pockets 52 of the pocket conveyor 50. In the process, the intake speed $V_2$ of the intake conveyor 34, 36 is controlled via a signal line 80 by the control unit 70. The control signals which trigger the withdrawal of individual print products 10 from the storage device 38 are transmitted by the control unit 70 via a signal line 82 to the withdrawing device 40. The pockets 52 of the pocket conveyor 50 which are not supplied by the withdrawing device 40 with print products 10, e.g. as indicated with the reference 52*a*, can be provided with print products 10 by an additional feeding device 60. The control signals which trigger the withdrawal of individual print products 10 from the additional feeding device 60 are transmitted by the control unit 70 via a signal line 81 to an additional withdrawing device 61. The number of print products 10 deposited in the storage device 38 is detected with the aid of a detection device 90, and corresponding detection signals are sent via a signal line 76 to the control unit 70. A further processing speed $V_3$ of the pocket conveyor 50 is transmitted via a signal line 74 from the control unit 70 to the pocket conveyor 50, wherein the further processing speed $V_3$ corresponds to the desired further processing speed $V_4$, modified as necessary by the control offset.

On the whole, a control signal can be transmitted to the release device 32 for each individual print product 10 that is supplied by the grippers 22 of the feed conveyor 20 during the operation of the apparatus shown in FIG. 1. A withdrawing signal can furthermore be transmitted to the withdrawing device 40 for each individual pocket 52 of the pocket conveyor 50, so as to ensure an optimum production capacity. During the course of this operation, the processing speed $V_3$ of the pocket conveyor 50 can be adjusted by the control unit 70 and, following a change in the speed $V_3$ for the further processing, the conveying speed $V_2$ of the intake conveyor 34, 36 can be changed by adjusting the control signals transmitted to the release device 32 and the control signals transmitted to the withdrawing device 40. Any gaps in the flow of the supplied print products 10 can be compensated for by withdrawing previously deposited print products 10 from the storage device 38. If problems occur during the further processing in the pocket conveyor 50, released print products 10 can be stored temporarily in the storage device 38. In order to compensate for these fluctuations in the production, the control signals transmitted via the signal lines 78 and 82 to the release device 32 and/or the withdrawing device 40 can be generated based on the number of print products 10 deposited in the storage device 38 and detected by the detection device 90. For compensating possible production fluctuations, the further processing speed $V_3$ of the pocket conveyor 50 can be allowed to fluctuate by a control offset around a desired further processing speed $V_4$. The desired further processing speed $V_4$ can be adjusted with the aid of an adjustment device that is assigned to the control unit 70 and is not shown in FIG. 1. For the embodiment of the invention shown in FIG. 1, the desired further processing speed $V_4$ of the pocket conveyor 50 was increased. This is obvious from the increasingly wider gaps between the print products 10 transported further by the grippers of the feed conveyor 20 for the operating mode shown in FIG. 1, starting from the left picture edge toward the right picture edge, wherein more print products 10 were transferred from the feed conveyor 20 to the pocket conveyor 50.

The mode of operation for the apparatuses according to the invention and/or the realizing of the methods according to the invention are explained in the following with the aid of an example:

For this example, the feeding speed of the feed conveyor 20 is preset to 60,000 copies per hour by the production unit for the printing press while the speed for the further processing device (e.g., including pocket conveyor 50) amounts to 40,000 copies per hour. Thus, only 66.6% of the supplied print products 10 can be processed further. It means that each third print product 10 that is supplied must move past the transfer region while suspended from a gripper 22 of the feed conveyor 20 and/or that the flow of supplied print products 10 must correspondingly be divided during a split step, wherein a split rate amounts to 66.6%. In general, the split rate (S) can be expressed as follows:

$$S = 100 \cdot \frac{V_4}{V_1} \quad [\%] \tag{1}$$

and wherein the split step can be expressed as follows:

$$\frac{100}{(100 - S)} \quad [\text{number of cycles}] \tag{2}$$

It is assumed in this case that a clocked feed conveyor 20 is used for which a single print product 10 moves past the release/transfer location 24 during each conveying cycle. If the desired processing speed $V_4$ of the further processing device (e.g., pocket conveyor 50) is higher than the feeding speed $V_1$ of the feed conveyor 20, a corresponding withdrawing rate (A) and withdrawing step are computed for the withdrawing device 40:

$$A = 100 \cdot \frac{V_1}{V_4} \quad [\%] \tag{3}$$

$$\text{and the withdrawing step} = \frac{100}{(100 - A)} \quad [\text{number of cycles}] \tag{4}$$

The following cases can thus occur:

1. $V_1 > V_4$. In that case, the flow of supplied print products 10 must be divided. Only enough print products 10 to equal the number that will be processed further are removed from the flow of supplied print products 10 (i.e., from the feed conveyor 20). In principle, products are always removed and a holding signal is generated for the release device 32 once a split step is reached.
2. $V_1 = V_4$. In that case, the flow of supplied print products 10 in the feed conveyor 20 does not have to be divided because all print products 10 are transferred from the grippers 22 of the feed conveyor 20 to the intake conveyor 34, 36 and all print products 10 are transferred with the aid of the withdrawing device 40 to the pocket conveyor 50.
3. $V_1 < V_4$. In that case, the supplied print products 10 in feed conveyor 20 are distributed to the pockets 52 of the pocket conveyor 50, wherein all supplied print products 10 are processed further while distributed to the pockets 52. This is achieved through a corresponding triggering of the withdrawing unit 40 once a withdrawing step is reached.

An embodiment of a method according to the invention is explained in the following with the aid of the flow chart shown in FIG. 2.

Figure 2:
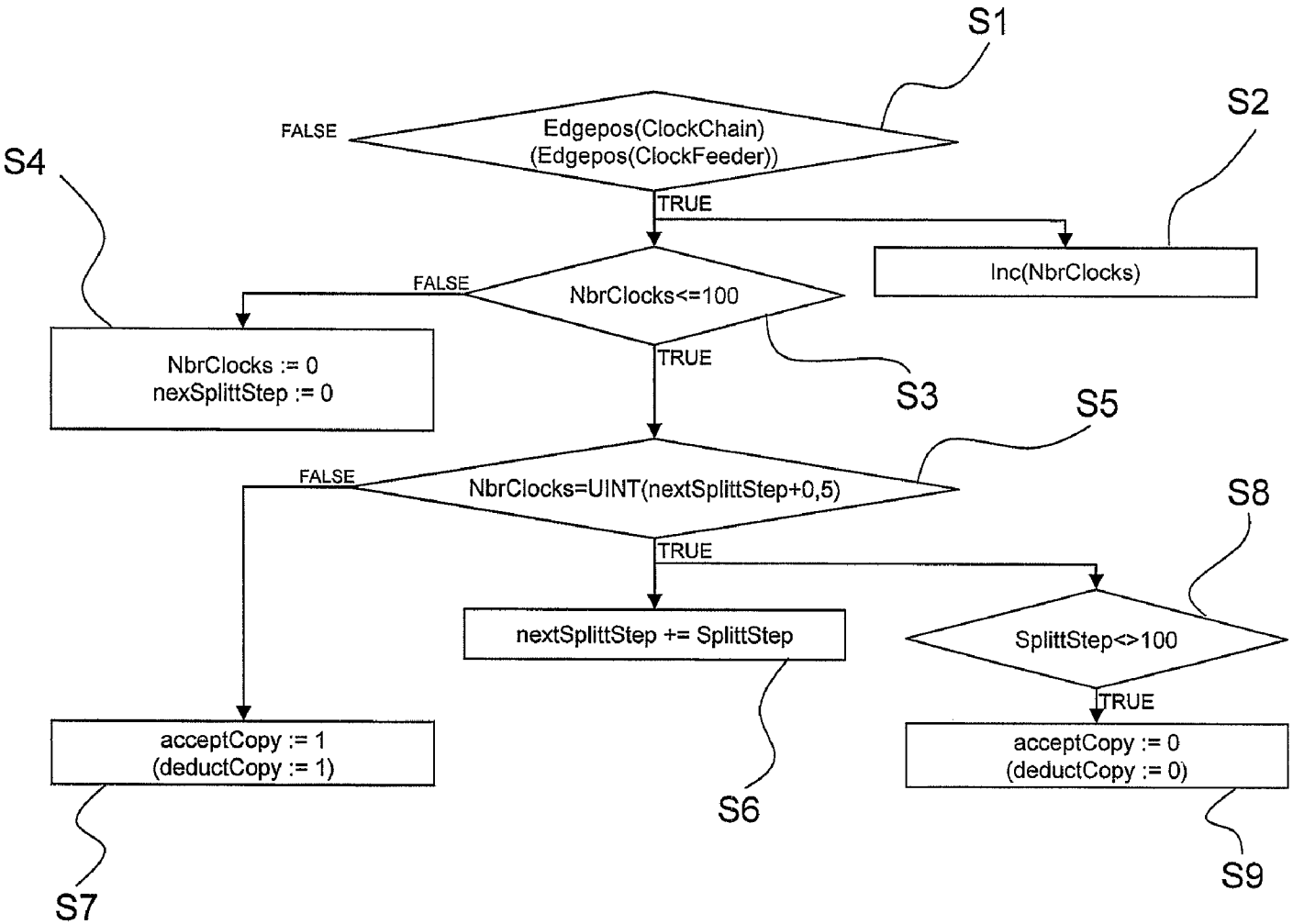
FIG. 2 depicts a flow chart for explaining the method according to an embodiment of the invention.

According to an embodiment of the method shown in FIG. 2, a check is made in step S1 to determine whether a print product 10 has reached a release location 24 of the feed conveyor 20. If a print product 10 reaches the release location 24, a clocking rate (NbrClocks) is incremented (step S2). A check is made at the same time to determine whether the clocking rate for the embodiment explained with the aid of FIG. 1 has reached the preset limit value of, for example, 100. If the value of 100 is exceeded, the clocking rate is reset to 0 (step S4). If the clocking rate of 100 has not yet been exceeded, the clocking rate is compared in step S5 to a holding rate UINT (nextSplitStep+0.5). If the clocking rate does not correspond to the holding rate, a release signal (accept-Copy:=1) is generated in step S7 for the respective print product 10 and is transmitted to the release device 32, so that the respective print product 10 is deposited on the intake conveyor 34, 36 and is supplied to the pocket conveyor 50 for the further processing. However, if is it determined during step S5 that the clocking rate corresponds to the holding rate, a check is made during step S8 to determine whether the holding rate is unequal to 100 and, if it is determined that this rate is in fact unequal to 100, then a holding signal (accept-Copy:=0) is generated and is transmitted to the release device 32, so that the corresponding print product 10 is conveyed further along the feeding section while suspended from the gripper of the feed conveyor 20. The holding rate is simultaneously increased by a split step during the step S6, wherein this split step is computed as explained in the above.

For the case where the further processing speed is higher than the feeding speed, the print products are divided and distributed accordingly to the individual pockets 52 of the pocket conveyor 50.

The invention is not restricted to the embodiment explained with the aid of FIG. 1. Differently designed feeding devices can also be used for feeding the print products 10. In the same way, the further processing of the print products 10 can also take place in differently designed further processing devices or machines. In addition, the intake conveyor 34, 36 can take the form of a single conveyor belt and, if applicable, the storage device 38 can be omitted. One skilled in the art can furthermore deduce other changes to be made based on the embodiment of the invention that is explained with the aid of FIG. 1.

It will be understood that the above description of the embodiments of the invention is susceptible to various modifications, changes and adaptations, and the same are intended to be comprehended within the meaning and range of equivalents of the appended claims.

What is claimed is:

1. A method for the processing of print products, comprising:

conveying individually the print products with a feeding device along a feeding section, wherein the feeding device comprises a feed conveyor including a number of grippers each configured to hold an individual print product;

transferring individually the print products from the feeding section to a further processing device along a further processing section;

storing the print products transferred from the feeding device to the further processing device in a storage device configured to accommodate a number of print products;

generating control signals from a control unit, the control signals corresponding to further treatment of each individual print product and to the transfer of precisely one print product to the further processing device, wherein the control signals comprise:

a first control signal which determines whether an individual print product is transferred to the further processing device; and a second control signal which determines timing of the transfer;

releasing the individual print product from a respective one of the grippers based on the first control signal;

supplying additional print products to the further processing device as a function of at least one of locations determined based on the second control signal or times determined based on the second control signal; and generating a continuous product flow along the further processing section as a result of the supplying of the additional print products.

2. The method according to claim 1, wherein the control signals are generated based on the number of print products supplied per unit of time by the feeding device and based on the number of print products which are further processed per unit of time by the further processing device.

3. The method according to claim 1, wherein the control signals are based on the number of print products held in the storage device.

4. The method according to claim 1, wherein the further processing device comprises a pocket conveyor including a number of pockets, the method further comprising:

supplying an individual print product to a respective one of the pockets of the pocket conveyor in response to the second control signal; and conveying the print products along the further processing section inside the pockets of the pocket conveyor.

5. The method according to claim 1, wherein the feeding device comprises a clocked feed conveyor and a removal location along the feeding section, the method further comprising:

generating the first control signal for each conveying cycle during which precisely one print product moves past the removal location.

6. The method according to claim 5, further comprising:

comparing a clocking rate to a holding rate for each conveying cycle, wherein the holding rate is based on a feeding speed of the feed conveyor and a further processing speed of the further processing device, wherein if the clocking rate corresponds to the holding rate, the first control signal is in the form of a holding signal which triggers the holding of the individual print product along the feeding section, and wherein if the clocking rate does not correspond to the holding rate, the first control signal is in the form of a release signal which triggers the releasing of the individual print product from the feeding device.

7. The method according to claim 6, wherein following the holding of the individual print product along the feeding section, the method further comprising:

increasing the holding rate by a predetermined amount; and resetting the clocking rate and the holding rate when the holding rate reaches a predetermined limit.

8. An apparatus for processing print products, the apparatus comprising:

a feeding device configured to convey the print products individually along a feeding section, wherein the feeding device comprises a feed conveyor including a number of grippers each configured to hold an individual print product;

a further processing device configured to receive and convey the print products along a further processing section;

a transfer device configured to transfer the print products from the feeding device to the further processing device and including a storage device configured to accommodate and store a number of the print products transferred from the feeding device to the further processing device; and a control unit configured to control the transfer of the print products from the feeding device to the further processing device, wherein the control unit is configured to generate control signals corresponding to further treatment of each individual supplied print product along the feeding section and to the transfer of precisely one print product via the transfer device to the further processing device, wherein the control signals comprise:

a first control signal which determines whether an individual print product is released from a respective one of the grippers and transferred to the further processing device; and a second control signal which determines timing of the transfer, whereby additional print products are supplied to the further processing device as a function of at least one of locations determined based on the second control signal or times determined based on the second control signal to generate a continuous product flow along the further processing section.

9. The apparatus according to claim 8, further comprising a detection unit assigned to the storage device, the detection unit being configured to detect the number of print products stored therein and to transmit corresponding detection signals to the control unit, and wherein the control unit is configured to generate the control signals based on the detection signals.

10. The apparatus according to claim 8, wherein the control unit is configured to control at least one of a feeding speed of the feeding device and a further processing speed of the further processing device, and wherein the control unit is configured to generate the control signals based on at least one of the feeding speed and the further processing speed.

11. The apparatus according to claim 8, further comprising an additional feeding device assigned to the further processing device and configured to supply print products to the further processing section.

12. The apparatus according to claim 8, wherein the feeding device comprises a clocked feed conveyor and a removal location along the feeding section, the control unit configured to generate the first control signal for each conveying cycle during which precisely one print product moves past the removal location.

13. The apparatus according to claim 12, wherein the control unit is configured to compare a clocking rate of the feed conveyor to a holding rate for each conveying cycle, the holding rate being based on a feeding speed of the feed conveyor and a further processing speed of the further processing device, wherein, when the clocking rate corresponds to the holding rate, the first control signal is in the form of a holding signal which triggers the holding of the individual print product along the feeding section, and wherein when the clocking rate does not correspond to the holding rate, the first control signal is in the form of a release signal which triggers the releasing of the individual print product from the feeding device.

14. The apparatus according to claim 13, wherein when the individual print product is held along the feeding section, the control unit is configured to increase the holding rate by a predetermined amount, and wherein when the holding rate reaches a predetermined limit the control unit is configured to reset the clocking rate.

15. The apparatus according to claim 8, further comprising an additional feeding device configured to supply the additional print products to the further processing section when a speed of the further processing section is higher than a speed of the feeding section.

16. The method according to claim 1, wherein the additional print products are supplied to the further processing section when a speed of the further processing section is higher than a speed of the feeding section.

17. A method for the processing of print products, comprising:

conveying individually the print products with a feeding device along a feeding section, wherein the feeding device comprises a clocked feed conveyor and a removal location along the feeding section;

transferring individually the print products from the feeding section to a further processing device along a further processing section; and generating control signals from a control unit, the control signals corresponding to further treatment of each individual print product and to the transfer of precisely one print product to the further processing device, wherein the generating control signals includes generating a first control signal each conveying cycle during which precisely one print product moves past the removal location.

18. The method according to claim 17, further comprising:

comparing a clocking rate to a holding rate for each conveying cycle, wherein the holding rate is based on a feeding speed of the feed conveyor and a further processing speed of the further processing device, wherein if the clocking rate corresponds to the holding rate, the first control signal is in the form of a holding signal which triggers the holding of the individual print product along the feeding section, and wherein if the clocking rate does not correspond to the holding rate, the first control signal is in the form of a release signal which triggers the releasing of the individual print product from the feeding device.

19. The method according to claim 18, wherein following the holding of the individual print product along the feeding section, the method further comprising:

increasing the holding rate by a predetermined amount; and resetting the clocking rate and the holding rate when the holding rate reaches a predetermined limit.

* * * * *